US005804512A

United States Patent [19]

Lickfield et al.

[11] Patent Number: 5,804,512

[45] Date of Patent: Sep. 8, 1998

[54] NONWOVEN LAMINATE FABRICS AND PROCESSES OF MAKING SAME

[75] Inventors: Deborah K. Lickfield, Easley; James M. Watt, Piedmont, both of S.C.; Stanley Littman, Roswell, Ga.; Robert F. Hyslop, Simpsonville, S.C.

[73] Assignee: BBA Nonwovens Simpsonville, Inc., Simpsonville, S.C.

[21] Appl. No.: 482,739

[22] Filed: Jun. 7, 1995

[51] Int. Cl.[6] ..... B32B 5/06

[52] U.S. Cl. ..... 442/346; 156/62.4; 156/62.8; 156/269; 156/308.2; 206/363; 206/524.6; 220/DIG. 11; 428/311.11; 428/311.57; 428/903; 442/351; 442/382

[58] Field of Search ..... 428/286, 296, 428/302, 303, 340, 311.5, 311.11, 311.51, 903; 206/524.6, 363; 220/DIG. 11; 156/62.4, 62.8, 308.2, 269; 442/340, 345, 346, 350

[56] References Cited

U.S. PATENT DOCUMENTS

| | | | |
|---|---|---|---|
| 4,011,067 | 3/1977 | Carey, Jr. . | |
| 4,041,203 | 8/1977 | Brock et al. . | |
| 4,215,682 | 8/1980 | Kubik et al. . | |
| 4,375,718 | 3/1983 | Wadsworth et al. . | |
| 4,419,993 | 12/1983 | Petersen . | |
| 4,536,440 | 8/1985 | Berg . | |
| 4,588,537 | 5/1986 | Klaase et al. . | |
| 4,608,173 | 8/1986 | Watanabe et al. . | |
| 4,662,005 | 5/1987 | Grier-Idris . | |
| 4,807,619 | 2/1989 | Dyrud et al. . | |
| 4,813,948 | 3/1989 | Insley . | |
| 4,863,785 | 9/1989 | Berman et al. . | |
| 4,874,399 | 10/1989 | Reed et al. . | |
| 4,874,659 | 10/1989 | Ando et al. . | |
| 4,920,960 | 5/1990 | Hubbard et al. . | |
| 4,921,645 | 5/1990 | Insley . | |
| 4,969,457 | 11/1990 | Hubbard et al. . | |
| 5,122,048 | 6/1992 | Deeds . | |
| 5,149,468 | 9/1992 | Hershelman . | |
| 5,150,703 | 9/1992 | Hubbard et al. . | |
| 5,254,297 | 10/1993 | Deeds . | |
| 5,306,534 | 4/1994 | Bosses . | |
| 5,307,796 | 5/1994 | Kronzer et al. . | |
| 5,322,061 | 6/1994 | Brunson . | |
| 5,409,766 | 4/1995 | Yausa et al. | 428/903 |
| 5,455,110 | 10/1995 | Connor | 428/903 |
| 5,464,688 | 11/1995 | Temmons et al. | 428/903 |
| 5,482,765 | 1/1996 | Bradley et al. | 428/903 |
| 5,486,411 | 1/1996 | Hassenboehler | 428/963 |
| 5,498,463 | 3/1996 | McDowall et al. | 428/903 |

*Primary Examiner*—James J. Bell
*Attorney, Agent, or Firm*—Bell Seltzer Intellectual Property Law Group of Alston & Bird LLP

[57] ABSTRACT

A nonwoven laminate fabric includes first and second nonwoven webs formed of spunbonded substantially continuous filaments and a nonwoven web of meltblown microfibers having a basis weight between about one and twenty grams per square meter sandwiched between and bonded to the first and second nonwoven webs to form a composite nonwoven fabric. The meltblown web includes a plurality of thermoplastic microfine fibers having an average fiber diameter of less than 1.5 microns. The nonwoven laminate exhibits good barrier properties and can be used as a sterile wrap.

36 Claims, 1 Drawing Sheet

NONWOVEN LAMINATE FABRICS AND PROCESSES OF MAKING SAME

FIELD OF THE INVENTION

The invention relates to nonwoven fabrics and to processes for producing nonwoven fabrics. More specifically, the invention relates to composite nonwoven fabrics having barrier properties which are particularly suited for medical applications.

BACKGROUND OF THE INVENTION

Nonwoven fabrics and fabric laminates are widely used in a variety of applications, for example, as components of absorbent products such as disposable diapers, adult incontinence pads, and sanitary napkins; in medical applications such as surgical gowns, surgical drapes, sterilization wraps, and surgical face masks; and in other numerous applications such as disposable wipes, industrial garments, house wrap, carpets and filtration media.

By combining two or more nonwoven fabrics of different types, nonwoven fabric laminates have been developed for a variety of specific end use applications. For example, nonwoven barrier fabrics have been developed which impede the passage of bacteria and other contaminants and which are used for disposable medical fabrics, such as sterilization wraps for surgical and other health care related instruments, surgical drapes, disposable gowns and the like.

Barrier fabrics can be formed by sandwiching an inner fibrous web of thermoplastic meltblown microfibers between two outer nonwoven webs of substantially continuous thermoplastic spunbonded filaments. The fibrous meltblown web provides a barrier impervious to bacteria or other contaminants in the composite nonwoven fabric. Examples of such fabrics are described in U.S. Pat. No. 4,041,203 and U.S. Pat. No. 4,863,785. Typically, nonwoven fabric laminates used as disposable medical fabrics include a meltblown layer formed of meltblown microfibers having an average diameter of about 1.8 to 3.0 microns and higher. In addition, the meltblown layer typically has a basis weight of about 20 to 40 grams per square meter.

Current industry standards require that laminate fabrics used for barrier purposes provide a predetermined level of protection against penetration of the fabric by air borne contaminants. The level of barrier protection required can depend upon the particular end use application of the fabric. Many laminate fabrics currently available cannot meet all of the requirements for a particular end use application.

For example, a single sheet of currently available barrier laminate fabric typically cannot meet all standards for barrier fabrics used as a sterile wrap. To provide the required degree of protection against penetration of the sterile wrap by air borne contaminants, current industry standards require that surgical instruments, and other items to be sterilized, be "double wrapped," i.e., that at least two sheets of the laminate fabric, cut to a predetermined size and shape, each be individually wrapped about the instruments and secured before sterilization.

Industry standards have recently allowed the use of a single sterile wrap formed of two sheets of a trilaminate fabric described above sonically bonded about the periphery thereof to form an integrated "single" sheet. This can eliminate time and labor involved in conventional techniques of wrapping and securing a first sheet of sterile wrap, followed by wrapping and securing a second sheet of sterile wrap about the objects to be sterilized. However, there can be problems associated with the integrated double layer sterile wrap, such as increased stiffness along the bonded edges, which can resist lateral folding of the sterile wrap.

Accordingly, despite these and other laminate fabrics which are currently available, it would be advantageous to provide a laminate fabric having improved barrier properties. In addition, it would be advantageous to provide such a laminate fabric which can be used as a single sheet to wrap objects which are to be subsequently sterilized, and would not require the labor of double wrapping such items. It would further be advantageous if such a laminate fabric were flexible and easily foldable.

SUMMARY OF THE INVENTION

The present invention provides nonwoven laminate fabrics which have superior barrier properties, and which are flexible and soft. The laminate fabrics of the invention can be used as components in any variety of nonwoven products, and are particularly useful as barrier components in medical fabrics, such as sterile wraps, surgical gowns, and the like.

The laminate fabrics of the invention include a nonwoven web of meltblown microfibers having a basis weight between about one and twenty grams per square meter, and preferably between about one and twelve grams per square meter. The meltblown web further includes a plurality of thermoplastic microfine fibers having an average fiber diameter of less than 1.5 microns, preferably between 0.5 and 1.5 microns and more preferably between 0.8 and 1.3 microns.

The meltblown web is sandwiched between and bonded to first and second nonwoven webs to form the composite nonwoven fabric of the invention. The outer webs can be, for example, spunbonded nonwoven webs or webs formed of staple fibers. Preferably, the meltblown web is sandwiched between outer spunbonded webs and the layers of the fabric are bonded together via a multiplicity of thermal bonds distributed throughout the laminate.

The thermoplastic microfine fibers of the meltblown component of the fabric are formed from any of various thermoplastic fiber forming materials known to the skilled artisan, such as polyolefins, polyesters, polyamides, and copolymers and blends thereof. Preferably, the polymer selected has a high melt flow rate as compared to polymers used in conventional meltblowing processes, i.e., at least about 1000, and even up to 1200 and higher.

The present invention also includes sterile wraps formed of the laminate nonwoven fabrics of the invention for wrapping about objects to be sterilized, as well as wrapped packages of sterilizable objects. Preferably the packages includes a single sheet of the sterile wrap of the invention. The sterile wrap exhibits excellent barrier properties, such as hydro head measurements, i.e., resistance to penetration of the fabric by water, of up to 80 cm water pressure, and up to 95%, and up to 98% and higher, efficiency against the passage of bacteria through the laminate fabric.

The present invention also includes a process for the manufacture of the nonwoven laminate fabrics of the invention. It has been found that relatively high melt flow rate thermoplastic polymers, i.e., 1000 MFR or higher, can be attenuated in a heated high velocity air stream in such a way suitable for the stable production of microfine microfibers and concurrent formation of a low basis weight web. These conditions include controlling the attenuation conditions (e.g. attenuation gas velocity and temperature), as well as selecting an appropriate melt flow rate polymer, to promote formation of microfine microfibers and low basis weight webs without significantly impairing or adversely impacting the process conditions, i.e., formation of fly.

Generally, the process conditions are selected so the attenuation gas velocity and temperature are increased up to ten percent and up to twenty-five percent and higher, relative to conventional processing parameters for a particular polymer system. These parameters can be increased without forming undesirable amounts of fly to form microfibers having a greatly reduced average diameter size as compared to conventional meltblown webs.

BRIEF DESCRIPTION OF THE DRAWINGS

Some of features and advantages of the invention having been stated, others will become apparent from the detailed description which follows, and the accompanying drawings which form a part of the original disclosure of this invention, and in which.

DETAILED DESCRIPTION OF THE INVENTION

The present invention will now be described more fully hereinafter with reference to the accompanying drawings, in which illustrative embodiments of the invention are shown. This invention may, however, be embodied in many different forms and should not be construed as limited to the embodiments set forth herein. Rather, this embodiment is provided so that the disclosure will be thorough and complete, and will fully convey the scope of the invention to those skilled in the art. Like numbers refer to like elements throughout. For purposes of clarity, the scale has been exaggerated.

Figure 1:
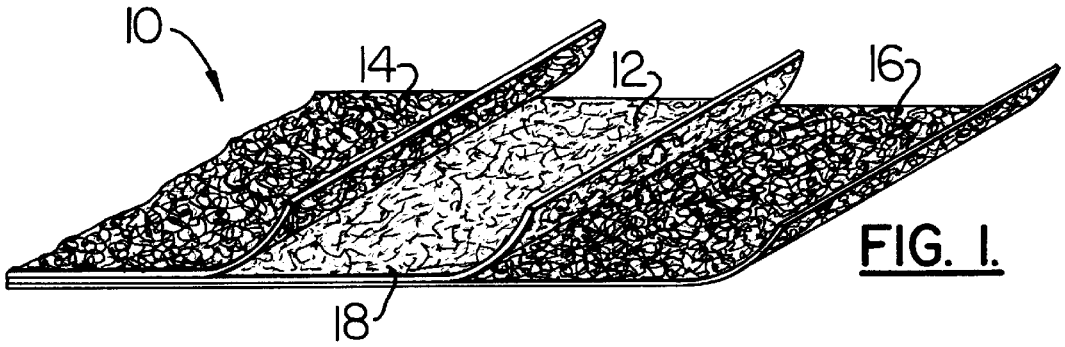
FIG. 1 is a fragmentary top view of a laminate fabric of the present invention, partially cut away to illustrate components thereof.

FIG. 1 is a fragmentary top view of a laminate fabric of the present invention, designated generally as 10. Laminate fabric 10 is partially cut away to illustrate the individual components thereof. The fabric is a three ply composite comprising an inner ply 12 sandwiched between outer plies 14 and 16. The composite fabric 10 has good strength, flexibility and drape and may be formed into various articles or garments such as sterile wraps, surgical gowns, surgical drapes and the like. The barrier properties of the fabric 10 make it particularly suitable for medical applications, but the fabric is also useful for any other application where barrier properties would be desirable.

Outer ply 14 of the composite fabric 10 is a nonwoven web of spunbonded substantially continuous thermoplastic filaments. The spunbonded web 14 may be produced using well known spunbonding processes, and may suitably have a basis weight in the range of about 10 to about 100 gsm. The thermoplastic filaments of ply 14 can be made of any of a number of known fiber forming polymer compositions. Such polymers include those selected from the group consisting of polyolefins such as polypropylene and polyethylene, polyesters, such as poly(ethylene terephthalate), polyamides such as poly(hexamethylene adipamide) and poly (caproamide), polyethylene, and copolymers and blends thereof.

Outer ply 16 may be either a web of spunbonded substantially continuous thermoplastic filaments or a web of staple fibers. In the embodiment illustrated, ply 16 is a nonwoven web of spunbonded substantially continuous thermoplastic filaments of a composition and basis weight similar to outer ply 14. The continuous filaments or staple fibers of outer ply 16 may be selected from the same polymers as described above for ply 14. Additionally, the staple fibers may be natural or synthetic fibers having hydrophilic properties to give one surface of the composite fabric absorbent characteristics. Examples of hydrophilic fibers include cotton fibers, wool fibers, rayon fibers, acrylic fibers, and fibers formed of normally hydrophobic polymers which have been treated or chemically modified to render them hydrophilic. When ply 16 is a nonwoven web of staple fibers, the nonwoven web can be a carded web or a wet-laid web of staple fibers.

In one aspect of this embodiment of the invention, ply 16 is a nonwoven web comprising a mixture of thermoplastic staple fibers and absorbent staple fibers. The nonwoven web comprises the absorbent fibers in an amount sufficient to impart absorbency characteristics to the web.

Inner ply 12 comprises a nonwoven fibrous web of meltblown thermoplastic microfibers. Specifically, meltblown web 12 is a nonwoven web comprising a plurality of thermoplastic microfine fibers 18. The microfine fibers of meltblown web 12 have an average fiber diameter of less than 1.5 microns, preferably an average fiber diameter from 0.5 and 1.5 microns, and more preferably from 0.8 to 1.3 microns. In addition, the basis weight of meltblown web 12 is between about 1 and 20 grams per square meter ("gsm"), and preferably between about 1 and 12 grams per square meter.

The microfibers 18 of meltblown web 12 can be formed using any of various thermoplastic fiber forming materials known to the skilled artisan. Such materials include polyolefins such as polypropylene and polyethylene, polyesters such as poly(ethylene terephthalate), polyamides, polyacrylates, polystyrene, thermoplastic elastomers, and blends of these and other known fiber forming thermoplastic materials. The polymer selected preferably has a relatively high melt flow rate, as compared to conventional polymers used in meltblowing processes, as explained in more detail below. In a preferred embodiment, meltblown web 12 is a nonwoven web of polypropylene meltblown microfibers.

Advantageously, meltblown web 12 is electrically treated to improve filtration properties of the web. Such electrically treated fibers are known generally in the art as "electret" fibrous webs. Electret fibrous filters are highly efficient in filtering air because of the combination of mechanical entrapment of particles in the air with the trapping of particles based on the electrical or electrostatic characteristics of the fibers. Both charged and uncharged particles in the air, of a size that would not be mechanically trapped by the filtration medium, will be trapped by the charged nature of the filtration medium. Meltblown web 12 can be electrically treated using techniques and apparatus know in the art.

Layers 12, 14 and 16 of the laminate fabric of the present invention can be bonded together to form a coherent fabric using techniques and apparatus known in the art. For example, layers 12, 14 and 16 can be bonded together by thermal bonding, mechanical interlocking, adhesive bonding, and the like. Preferably, laminate fabric 10 includes a multiplicity of discrete thermal bonds distributed throughout the fabric, bonding layers 12, 14 and 16 together to form a coherent fabric.

In addition, as will be appreciated by the skilled artisan, laminate fabric 10 can include one or more additional layers to provide improved barriers to transmission of liquids, airborne contaminants, etc., or additional supporting layers.

Meltblown web 12 of the invention exhibits a variety of desirable characteristics, which make the web particularly useful as a barrier component in a laminate fabric, such as a sterile wrap. Because the microfibers of the web have extremely small fiber diameters, the surface area of the meltblown microfibers is greatly increased, as compared to conventional microfibers. In contrast, conventional meltblown webs incorporated as a component in a face mask include microfine fibers having an average fiber diameter of about 1.8 to 3.0 microns, and higher. Further, by incorporating microfine fibers having an average fiber diameter of less than 1.5 microns, the resultant meltblown web allows a packing density which, combined with the high surface area provided by the microfine fibers, provides significantly improved barrier properties of the fabric.

In addition, the basis weight of the meltblown web of the invention is greatly reduced, i.e. between 1 and 20 gsm, and preferably between 1 and 12 gsm. In contrast, the basis weight of conventional meltblown webs used in barrier applications typically have a basis weight from 20 to 40 gsm. As a result, meltblown web 12 can provide a lightweight component of a laminate fabric, and provide increased flexibility and ability to conform about objects, such as surgical items to be sterilized, without significantly impairing or diminishing the barrier properties of the web, for example, against passage of airborne contaminants and bacteria. Accordingly, although the meltblown web of the laminate of the invention includes both an average fiber diameter and basis weight well below that of conventional meltblown webs, the resultant web has excellent barrier properties.

The superior barrier properties of the meltblown component 12 of the laminate fabric 10 of the present invention makes the meltblown web a superior candidate as a component for disposable medical fabrics, including sterile wraps, where barrier properties are required but can be poorly delivered by existing commercial products. Accordingly, a laminate fabric 10 as described above can be used as a sterile wrap.

Figure 2A:
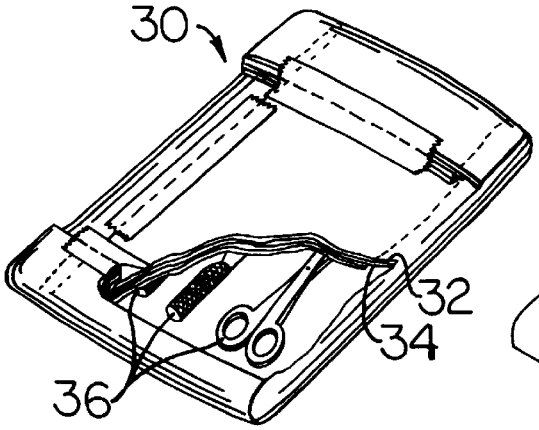
FIG. 2A is a perspective top view of a conventional "double wrapped" sterile package, partially cut away to illustrate the double sheet construction thereof.

Referring now to FIG. 2A, a perspective top view of a conventional "double wrapped" sterile package, designated generally as 30, is illustrated. The package includes at least two sheets 32 and 34 of a trilaminate fabric, wrapped about items 36 to be sterilized. The items to be sterilized can be surgical instruments, as illustrated, although as the skilled artisan will appreciate, the items can be any of the types of items which are sterilized before use. As noted above, to meet current industry standards of barrier protection, at least two sheets of a trilaminate fabric can be necessary to provide adequate barrier protection in a sterile wrap.

Figure 2B:
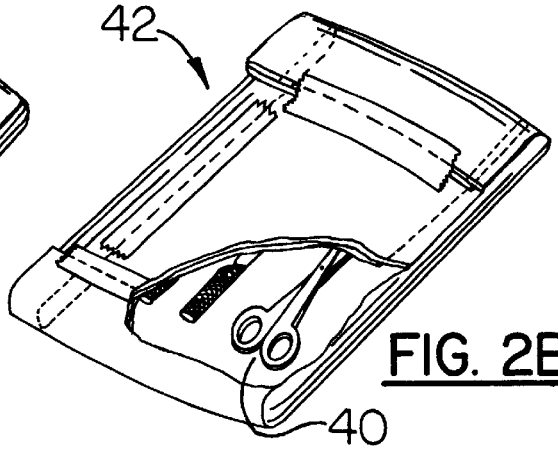
FIG. 2B is a perspective top view of a single wrapped sterile package of the present invention, formed of the laminate fabric of FIG. 1, partially cut away to illustrate the single sheet construction thereof.

In contrast, as illustrated in FIG. 2B, the present invention also includes a sterile wrap 40 formed of the laminate fabric of the present invention, a single sheet of which can be wrapped about the items to be sterilized to form a single layer sterile wrap package 42. Specifically, FIG. 2B is a perspective top view of single sheet sterile wrap package 42 of the present invention, partially cut away to illustrate the single layer construction thereof.

The sterile wrap 40, and thus the sterile wrap package 42, of the invention exhibit excellent barrier properties and meet current industry standards without the need of "double wrapping" the sterilizable items. Accordingly, the present invention provides not only a superior barrier fabric, but also can provide increased efficiency in preparing items for sterilization by eliminating repetitive folding and securing steps required for double wrapping conventional barrier laminate sheets. Further, because a single sheet of the laminate fabric of the invention is used, bonding about the periphery thereof, which can result in decreased flexibility and increased difficulty in folding, can be avoided.

Instruments contained within sterile wrap package 42 of the present invention can be sterilized using any of the techniques known in the art for sterilization of surgical instruments and other health care related items. Such sterilization techniques include steam sterilization at a temperature of about 250°–280° F., ethylene oxide sterilization at a temperature of about 130° F., gamma irradiation, and the like.

Figure 3:
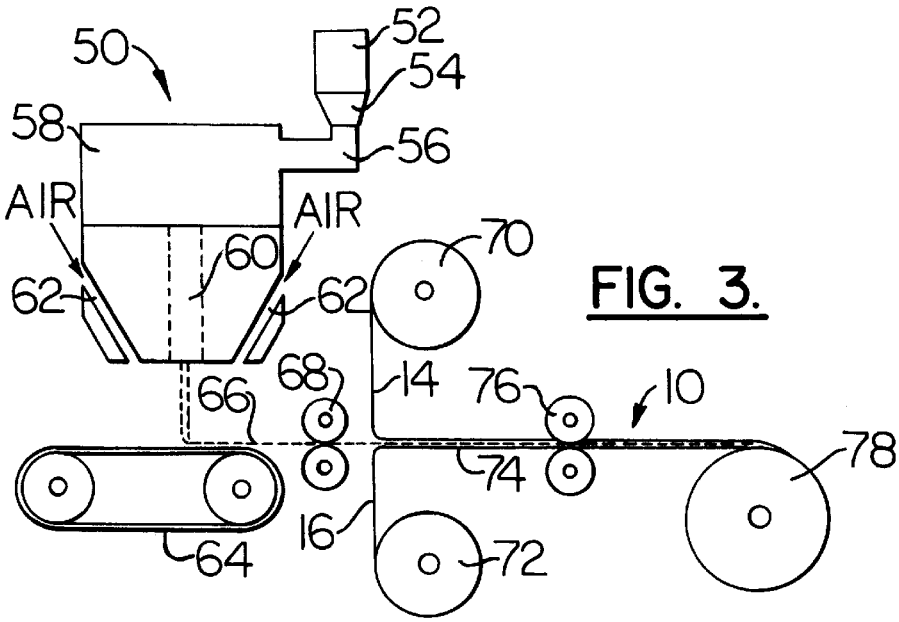
FIG. 3 is a schematic side view of an illustrative process in accordance with the present invention for forming the laminate fabric of FIG. 1.

Referring now to FIG. 3, an illustrative process for forming the meltblown web 12 and the laminate fabric 10 of the present invention is illustrated. FIG. 3 includes a simplified, diagrammatic illustration of an apparatus, designated generally as 50, capable of carrying out the method of forming a meltblown web in accordance with the invention. Conventional meltblowing apparatus known in the art can be used.

In meltblowing, thermoplastic resin is fed into an extruder where it is melted and heated to the appropriate temperature required for fiber formation. The extruder feeds the molten resin to a special meltblowing die. The die arrangement is generally a plurality of linearally arranged small diameter capillaries. The resin emerges from the die orifices as molten threads or streams into high velocity converging streams of heated gas, usually air. The air attenuates the polymer streams and breaks the attenuated streams into a blast of fine fibers which are collected on a moving screen placed in front of the blast. As the fibers land on the screen, they entangle to form a cohesive web.

The technique of meltblowing is known in the art and is discussed in various patents, e.g., Buntin et al, U.S. Pat. No. 3,978,185; Buntin, U.S. Pat. No. 3,972,759; and McAmish et al, U.S. Pat. No. 4,622,259.

In the present invention, process parameters of the meltblowing process are selected and controlled to form the microfine microfibers of the meltblown webs of the invention while minimizing or eliminating processing complications, i.e., without concurrently forming substantial amounts of loose fibers, i.e., fly, which can interfere with processing efficiency and cause defects in the meltblown web.

It has been found that relatively high MFR thermoplastic polymers, i.e., 1000 MFR or higher, can be attenuated in a heated high velocity air stream in such a way suitable for the stable production of microfine microfibers and concurrent formation of a microfibrous nonwoven low basis weight web. These conditions include controlling the attenuation conditions (e.g. attenuation gas velocity and temperature), as well as selecting an appropriate MFR polymer, to promote formation of microfine microfibers and low basis weight webs without significantly impairing or adversely impacting the process conditions, i.e., formation of fly.

As will be appreciated by the skilled artisan, as the temperature and velocity of the attenuation gas increases, collection of the fibers can become more difficult. Indeed, elevated temperatures and increased attenuation gas velocities can result in the formation of fibers too short to be collected on the collection surface. For example, conventionally, to form microfibrous meltblown polypropylene webs which can be incorporated as a barrier layer in a nonwoven laminate fabric, attenuation process conditions are adjusted so that attenuation gas temperatures are from 515° F. (268° C.) to 525° C. (274° C.). Further, attenuation gas velocities conventionally are about 20 cubic feet per minute ("cfm") per inch of the width of the die.

If the temperature and velocity of the gas is increased beyond these ranges, fibers which are too short to be collected can be formed, known as "fly." These stray fibers tend to float in the air in the area surrounding the meltblowing equipment, and can land on the formed web, thus creating a defect in the fabric. Further, elevated temperatures and gas velocities can result in the formation of "shot" or globules of solid polymer in the web.

In the present invention, the inventors have found that despite conventional wisdom regarding the use of elevated temperatures and increased velocities of the attenuation gas, these process parameters can be increased up to 10 percent, and even up to 25 percent and higher, relative to conventional processing parameters for a particular polymer system. These parameters can be increased without forming undesirable amounts of fly to form microfibers having a greatly reduced average diameter size as compared to conventional meltblown webs.

This increase in processing parameters is further adjusted in accordance with the characteristics of the polymer system being processed. That is, polymers having high melt flow rates relative to conventional meltblowing polymers can be processed to form the meltblown webs described above by increasing attenuation gas velocity and temperature. Typically, meltblown webs are formed from polymers having a melt flow rate of about 800 or lower, believed necessary for cohesiveness and strength. Polymers having melt flow rates higher than about 1000 were believed to be too flowable for smooth attenuation. However, the inventors have found that polymers having a melt flow rate up to 1000, and even up to and greater than 1200 can be meltblown using the above attenuation air temperatures and velocities. The melt flow rate is determined according to ASTM test procedure D-1238 and refers to the amount of polymer (in grams) which can be extruded through an orifice of a prescribed diameter under a mass of 2.16 kg at 230° C. in 10 minutes. The MFR values as used herein have units of g/10 min. or dg/min.

As the melt flow rate (MFR) of the polymer increases, for example to levels above 2000, and greater, the attenuation gas velocity and temperature do not necessarily have to increase as much as with polymers having a melt flow rate range from about 1000 to 1200 to achieve the same end product. Accordingly, all of these factors, i.e., the attenuation gas velocity and temperature, as well as the polymer system used (i.e., the type of polymer used, MFR, melt temperature, etc.) are taken into account when determining the process parameters for a particular polymer used to form the meltblown webs of the invention.

For example, to form meltblown microfibers of a polypropylene polymer having a melt flow rate of about 1000, the temperature of the attenuation gas can be increased to at least about 565° F. (295° C.) to 575° F. (300° C.), and even up to about 645° F. (335° C.) to 655° F. (340° C.). As noted above, as will be appreciated by the skilled artisan, the temperature of the attenuation gas can vary according the particular polymer system used. For example, to form a polyester meltblown web of the invention, attenuation air temperatures could range from about 580° F. to about 660° F., in contrast to conventional temperatures used of about 540° F. to about 600° F.

In addition, the speed of the attenuation gas can be increased to at least about 25 cfm, and up to about 30 cfm, per inch of the width of the meltblowing die, and higher. As the skilled artisan will also appreciate, attenuation gas velocities can be dependent upon the configuration of the meltblowing apparatus. For example, as the distance from the orifice through which the attenuation gas exits to the orifice through which the polymer is extruded increases, for attenuation gas streams supplied at equal velocities, a greater volume of gas will be pushed through the gas supplying nozzles, thus in effect increasing the gas velocity.

Referring again to FIG. 3, as shown, thermoplastic polymer pellets of a polymer are placed in a feed hopper 52 of a screw extruder 54 where they are heated to a temperature sufficient to melt the polymer. Advantageously the polymer has a MFR of at least 1000. Alternatively, as will be appreciated by the skilled artisan, polymers having a MFR of less than 1000 can be used in combination with a visbreaking agent, such as a peroxide, which degrades the polymer and reduces the melt flow rate thereof to form a polymer which exiting the extruder has a MFR of at least 1000. Visbreaking agents and techniques are known in the art. The molten polymer is forced by the screw through conduit 56 into a spinning block 58 and the polymer is extruded from the spin block 58 through a plurality of small diameter capillaries 60 into a high velocity gas stream, such as compressed air designated generally as 62. The temperature and velocity of the air is controlled as described above to form microfine meltblown microfibers having an average fiber diameter of less than about 1.5 microns.

The meltblown microfibers are deposited onto a foraminous endless belt 64 and form a coherent web 66 which is removed from the belt by a pair of consolidation rolls 68. The rolls optionally may include bonding elements (not shown) in the form of a relief pattern to provide a desired extent of point bonding of the microfibrous web. At these points where heat and pressure is applied, the fibers fuse together, resulting in strengthening of the web structure.

The microfibrous web 66 can then be electrically treated to impart an electrical charge to the fabric, and thus improve its filtration capabilities. Techniques and apparatus for electrically treating a nonwoven web are known in the art.

The microfibrous web can then be removed from the assembly and stored on a roll. Alternatively, as illustrated, the microfibrous web can be passed on to additional manufacturing processes, as described in more detail below.

As illustrated in FIG. 3, the microfibrous web 66 is fed through consolidation rolls 68 and is combined with a pre-formed web 14 and preformed web 16, drawn from supply rolls 70 and 72, respectively, to form a laminate 74.

As described above, at least one of preformed webs 14 and 16 can be spunbonded webs of continuous filaments. The spunbonding process involves extruding a polymer through a generally linear die head or spinneret for melt spinning substantially continuous filaments. The spinneret preferably produces the filaments in substantially equally spaced arrays and the die orifices are preferably from about 0.002 to about 0.040 inches in diameter.

The substantially continuous filaments are extruded from the spinneret and quenched by a supply of cooling air. The filaments are directed to an attenuator after they are quenched, and a supply of attenuation air is admitted therein. Although separate quench and attenuation zones can be used, it will be apparent to the skilled artisan that the filaments can exit the spinneret directly into the attenuator where the filaments can be quenched, either by the supply of attenuation air or by a separate supply of quench air.

The attenuation air may be directed into the attenuator by an air supply above the entrance end, by a vacuum located below a forming wire or by the use of eductors integrally formed in the attenuator. The air proceeds down the attenuator, which narrows in width in the direction away from the spinneret, creating a venturi effect and causing filament attenuation. The air and filaments exit the attenuator, and the filaments are collected on the collection screen. The attenuator used in the spunbonding process may be of any suitable type known in the art, such as a slot draw apparatus or a tube-type (Lurgi) apparatus.

Alternatively, at least one of webs 14 and 16 can be a carded web formed of staple length textile fibers, or a wet-laid or air-laid web of staple fibers, including bicomponent staple length textile fibers. While pre-formed webs 14 and 16 are shown, it will be appreciated that the webs could be formed in a continuous in-line process and combined with meltblown web 66. It will also be understood that additional webs could be combined with meltblown web 66, on one or both sides thereof.

The three-layer laminate 74 is conveyed longitudinally as shown in FIG. 3 to a conventional thermal fusion station 76 to provide a composite bonded nonwoven fabric 10. The fusion station is constructed in a conventional manner as known to the skilled artisan, and advantageously includes bonding rolls. Preferably, the layers are bonded to provide a multiplicity of thermal bonds distributed throughout the laminate fabric. Because of the wide variety of polymers which can be used in the fabrics of the invention, bonding conditions, including the temperature and pressure of the bonding rolls, vary according to the particular polymers used, and are known in the art for differing polymers.

Although a thermal fusion station in the form of bonding rolls is illustrated in FIG. 3, other thermal treating stations such as ultrasonic, microwave or other RF treatment zones which are capable of bonding the fabric can be substituted for the bonding rolls of FIG. 3. Such conventional heating stations are known to those skilled in the art and are capable of effecting substantial thermal fusion of the nonwoven webs. In addition other bonding techniques known in the art can be used, such as by hydroentanglement of the fibers, needling, and the like. It is also possible to achieve bonding through the use of an appropriate bonding agent as known in the art.

The resultant fabric 10 exits the thermal fusion station and is wound up by conventional means on a roll 78. The resulting laminate provide superior barrier and filtration properties. In addition, the laminate also allows a sterilization medium, such as steam, ethylene oxide gas, and the like, to penetrate the fabric to sterilize objects contained within.

The present invention is subject to numerous variations. For example, the polymers used in the present invention may be specifically engineered to provide or improve a desired property in the composite. For example, any one of a variety of adhesion-promoting, or "tackifying," agents, such as ethylene vinyl acetate copolymers, may be added to the polymers used in the production of any of the webs of the composite structure, to improve inter-ply adhesion. Further, at least one of the outer webs may be treated with a treatment agent to render any one of a number of desired properties to the fabric, such as flame retardancy, hydrophilic properties, and the like.

Additionally, the fibers or filaments used in any of the webs of the composite structure may comprise a polymer blend or bicomponent polymeric structure. For example, in one embodiment of the invention, fibers employed in the carded web can be sheath/core or similar bicomponent fibers wherein at least one component of the fiber is polyethylene. The bicomponent fibers can provide improved aesthetics such as hand and softness based on the surface component of the bicomponent fibers, while providing improved strength, tear resistance and the like due to the stronger core component of the fiber. Preferred bicomponent fibers include polyolefin/polyester sheath/core fibers such as a polyethylene/polyethylene terephthalate sheath core fiber.

Additionally, although the method illustrated in FIG. 3 employs a meltblown web sandwiched between two spunbonded webs, it will be apparent that different numbers and arrangements of webs can be employed in the invention. For example, the composite nonwoven fabric of the invention may comprise a spunbonded/meltblown web composite. Alternatively, the meltblown web can be sandwiched between a spunbonded web and a carded web. Additionally, several meltblown layers can be employed in the invention and/or greater numbers of other fibrous webs can be used. Nonwoven webs other than carded webs are also advantageously employed in the nonwoven fabrics of the invention. Nonwoven staple webs can be formed by air laying, garnetting, and similar processes known in the art.

The present invention will be further illustrated by the following non-limiting example.

EXAMPLE

Meltblown webs were formed by meltblowing polypropylene resins having a melt flow rate of about 1250. The resin was meltblown at varying temperatures and air velocity speeds. The webs were electret treated using an apparatus of the University of Tennessee, which can result in a fabric which can maintain the electric charge for a long period of time and maintain the charge to a large degree after the fabric is sterilized, for example using steam and/or gamma sterilization. The drop in pressure across the web (Delta P) as well as filtration efficiency was measured for each web. The results are set forth below in Table 1.

TABLE 1

| Trial # | gsm | Diameter, $\mu$ | Air Perm cfm | $\Delta P$ | % BFE* |
|---|---|---|---|---|---|
| 1 | 1.0 | 0.8 | 331 | 0.3 | 99.2 |
| 2 | 3.0 | 1.1 | 174 | 0.7 | 99.5 |
| 3 | 5.0 | 1.3 | 144 | 0.8 | 99.9 |
| 4 | 20.0 | 1.7 | 54 | 2.0 | 99.9 |
| 5 | 42.0 | 2.7 | 57 | 2.1 | 90.4 |

*electret treated

The filtration efficiency of each web was tested using a standard BFE (a bacteria filtration efficiency) test, Nelson Labs Test #AB010. *Staphylococcus aureus* was nebulized into a spray mist and forced through an aperture in a closed conduit. The bacteria passing through the aperture were captured on agar plates held in an Andersen sampler. The same procedure was repeated with samples of the meltblown webs blocking the aperture of the conduit. After a period of at least 18 hours, the bacteria colonies were counted. The efficiency of filtration was determined by comparing the colony count on the plates with and without the meltblown web samples. Results are expressed as a percentage which represents the reduction of the bacteria colonies when the meltblown webs were in place.

The drop in pressure in millimeters ("mm") of water across each of the fabric samples was also measured using a constant flow rate (85 liters per minute) of air through a 100 square centimeter area of the web. As set forth in Table 1, the meltblown webs exhibit a pressure differential from 0.3 to 0.8. Such a low differential in pressure across the webs provides excellent breathability, despite the ability of the webs to filter particles.

Trilaminate fabrics including outer spunbonded polypropylene webs thermally bonded to various ones of the meltblown webs prepared above were formed. A variety of properties of the laminate fabric were measured, including hydro head, bacteria filtration efficiency (BFE) and the like.

The trilaminate fabrics exhibited BFE values (measured as described above) up to 95%, and even as high as 98%. Accordingly, using this measurement of barrier efficiency, the laminate fabrics of the invention can exhibit superior barrier and filtration properties.

In addition, the ability of the laminate fabrics to withstand water pressure applied to one surface of the fabric before breaching or impairing the barrier properties thereof were also measured. Specifically, the barrier protection of the laminate fabrics was evaluated in terms of centimeters of water pressure which can be withstood by the fabric before compromising the barrier thereof (referred to as "hydro head" measurements). A single sheet of the fabric of the invention can exhibit hydro head measurements of up to 80 cm. For purposes of comparison, currently commercially available laminate fabrics having a meltblown component formed of 1.5 to 1.7 micron average diameter microfibers exhibit hydro head measurements of at best about 45 to 55 cm, and two sheets of this material exhibit a hydro head of about 75 to 90 cm.

Further, the laminate fabrics of the invention exhibit high flexibility (i.e., ease of handling) and superior softness. The fabrics provides sterilent penetration and residual value equal to or better than that provided by commercially available products.

The foregoing example is illustrative of the present invention, and is not to be construed as limiting thereof. The invention is defined by the following claims, with equivalents of the claims to be included therein.

That which is claimed:

1. A nonwoven laminate fabric, comprising:

first and second nonwoven webs; and a nonwoven web of meltblown microfibers having a basis weight between about one and twenty grams per square meter sandwiched between and bonded to said first and second nonwoven webs to form a composite nonwoven fabric, said meltblown web comprising a plurality of thermoplastic microfine fibers having an average fiber diameter of less than 1.5 microns and comprising polypropylene having a melt flow rate of at least about or greater than 1,000.

2. The laminate fabric according to claim 1 further comprising a multiplicity of thermal bonds bonding said first and second nonwoven webs and said meltblown web together to form a coherent laminate fabric.

3. The laminate fabric according to claim 1, wherein said meltblown web comprises a plurality of thermoplastic microfine fibers having an average fiber diameter between about 0.5 and 1.5 microns.

4. The laminate fabric according to claim 1, wherein said meltblown web comprises a plurality of thermoplastic microfine fibers having an average fiber diameter between about 0.8 and 1.3 microns.

5. The laminate fabric according to claim 1, wherein said meltblown web has a basis weight between about one and twelve grams per square meter.

6. The laminate fabric according to claim 1, wherein said thermoplastic microfine fibers are formed of polypropylene having a melt flow rate of greater than 1,200.

7. A sterile wrap formed of a laminate nonwoven fabric for wrapping about objects to be sterilized for use in subsequent applications requiring sterilized objects, comprising:

first and second nonwoven webs formed of spunbonded substantially continuous filaments;

a nonwoven web of meltblown microfibers having a basis weight between about one and twenty grams per square meter sandwiched between and bonded to said first and second nonwoven webs to form a composite nonwoven fabric, said meltblown web comprising a plurality of thermoplastic microfine fibers having an average fiber diameter of less than 1.5 microns and comprising polypropylene having a melt flow rate of at least about or greater than 1,000.

8. The sterile wrap according to claim 7, wherein said meltblown web comprises a plurality of thermoplastic microfine fibers having an average fiber diameter between about 0.5 and 1.5 microns.

9. The sterile wrap according to claim 7, wherein said meltblown web comprises a plurality of thermoplastic microfine fibers having an average fiber diameter between about 0.8 and 1.3 microns.

10. The sterile wrap according to claim 7, wherein said meltblown web has a basis weight of between about one and twelve grams per square meter.

11. The sterile wrap according to claim 7, wherein said polypropylene has a melt flow rate of at least 1200.

12. The sterile wrap according to claim 7, wherein said first and second nonwoven webs comprise spunbonded substantially continuous polypropylene filaments.

13. The sterile wrap according to claim 7, wherein said sterile wrap can withstand an increase in pressure against one surface thereof of up to about 80 cm water pressure without compromising the integrity of the sterile wrap.

14. The sterile wrap according to claim 7, wherein said sterile wrap exhibits a bacteria filtration efficiency at least about 95%.

15. The sterile wrap according to claim 7, wherein said sterile wrap exhibits a bacteria filtration efficiency at least about 98%.

16. The sterile wrap according to claim 7, wherein said sterile wrap further comprises a multiplicity of thermal bonds bonding said first and second nonwoven webs and said meltblown web together to form a coherent laminate fabric.

17. A wrapped package of sterilizable objects comprising a sterile wrap wrapped about said sterilizable objects, said sterile wrap formed of a laminate nonwoven fabric comprising:

first and second nonwoven webs formed of spunbonded substantially continuous filaments; and a nonwoven web of meltblown microfibers having a basis weight between about one and twenty grams per square meter sandwiched between and bonded to said first and second nonwoven webs to form a composite nonwoven fabric, said meltblown web comprising a plurality of thermoplastic microfine fibers having an average fiber diameter of less than 1.5 microns and comprising polypropylene having a melt flow rate of at least about or greater than 1,000.

18. The wrapped package according to claim 17 wherein said wrapped package comprises a single sheet of said laminate fabric.

19. The wrapped package according to claim 17, wherein said meltblown web comprises a plurality of thermoplastic microfine fibers having an average fiber diameter between about 0.5 and 1.5 microns.

20. The wrapped package according to claim 17, wherein said meltblown web comprises a plurality of thermoplastic microfine fibers having an average fiber diameter between about 0.8 and 1.3 microns.

21. The wrapped package according to claim 17, wherein said meltblown web has a basis weight of between about one and twelve grams per square meter.

22. The wrapped package according to claim 17, wherein said thermoplastic microfine fibers are formed of polypropylene having a melt flow rate of greater than 1,200.

23. The wrapped package according to claim 17, wherein said first and second nonwoven webs comprise spunbonded substantially continuous polypropylene filaments.

24. The wrapped package according to claim 17, wherein said a single sheet of said sterile wrap can withstand an increase in pressure against one surface thereof of up to about 80 cm water pressure without comprising the integrity of the sterile wrap.

25. The wrapped package according to claim 17, wherein a single sheet of said sterile wrap exhibits a bacteria filtration efficiency at least about 95%.

26. The wrapped package according to claim 17, wherein a single sheet of said sterile wrap exhibits a bacteria filtration efficiency at least about 98%.

27. The wrapped package according to claim 17, wherein said sterile wrap further comprises a multiplicity of discrete thermal bonds distributed substantially throughout said sterile wrap.

28. A process for the manufacture of a nonwoven laminate fabric, the process comprising:

forming a meltblown web comprising a plurality of thermoplastic microfine meltblown fibers having an average fiber diameter of less than 1.5 microns and comprising polypropylene having a melt flow rate of at least about or greater than 1,000, said meltblown web having a basis of weight between about one and twenty grams per square meter;

sandwiching said meltblown nonwoven web between opposing nonwoven webs formed of spunbonded substantially continuous filaments to form a laminate fabric; and bonding said opposing nonwoven webs and said meltblown web together to form a coherent laminate fabric.

29. The process according to claim 28, wherein the step of forming a meltblown web comprises forming a meltblown web comprising a plurality of thermoplastic microfine fibers having an average fiber diameter between 0.5 and 1.5 microns.

30. The process according to claim 28, wherein the step of forming a meltblown web comprises forming a meltblown web comprising a plurality of thermoplastic microfine fibers having an average fiber diameter between 0.8 and 1.3 microns.

31. The process according to claim 28, wherein the step of forming a meltblown web comprises forming a meltblown web having a basis weight of between about one and twelve grams per square meter.

32. The process according to claim 28, wherein the step of forming a meltblown nonwoven web comprises forming a meltblown web from polypropylene having a melt flow rate of greater than 1,200.

33. The process according to claim 28, wherein the step of bonding said laminate fabric comprises thermally bonding said laminate fabric to form a multiplicity of discrete thermal bonds distributed throughout said fabric.

34. A process for the manufacture of a sterile wrap for wrapping about items to be sterilized for use in subsequent applications requiring sterilized items, the process comprising:

forming a meltblown web comprising a plurality of thermoplastic microfine meltblown fibers comprising polypropylene having a melt flow rate of at least about or greater than 1,000, said microfibers having an average fiber diameter of less than 1.5 microns, said meltblown web having a basis of weight between about one and twenty grams per square meter;

sandwiching said meltblown nonwoven web between opposing nonwoven webs formed of spunbonded substantially continuous filaments to form a laminate fabric;

bonding said opposing nonwoven webs and said meltblown web together to form a coherent laminate fabric; and cutting said laminate fabric into a sheet having a predetermined shape and size.

35. A process for preparing a wrapped package of sterilizable objects, comprising:

placing sterilizable items onto a single layer of a sterile wrap formed of a laminate nonwoven fabric comprising a first and second nonwoven webs formed of spunbonded substantially continuous filaments and a nonwoven web of meltblown microfibers having a basis weight between about one and twenty grams per square meter sandwiched between and bonded to said first and second nonwoven webs to form a composite nonwoven fabric, said meltblown web comprising a plurality of thermoplastic microfine fibers comprising polypropylene having a melt flow rate of at least about or greater than 1,000, said microfibers having an average fiber diameter of less than 1.5 microns; and wrapping and securing the edges of said sterile wrap about said sterilizable items to form a sterile wrap package.

36. The process according to claim 35 further comprising the step of subjecting said sterile wrap package to sterilization conditions after said wrapping and securing step.

* * * * *

UNITED STATES PATENT AND TRADEMARK OFFICE
CERTIFICATE OF CORRECTION

PATENT NO. : 5,804,512

DATED : September 8, 1998

INVENTOR(S) : Lickfield et al.

It is certified that error appears in the above-identified patent and that said Letters Patent is hereby corrected as shown below:

Title page, item [56],

In the References Cited, U.S. PATENT DOCUMENTS, line 25, "Yausa" should read --Yuasa--; line 27, "Temmons" should read --Timmons--; line 29, "Hassenboehler" should read --Hassenboehler, Jr. et al.--.

Add --FOREIGN PATENT DOCUMENTS

| | | |
|---|---|---|
| 674,035 | 9/1995 | EPO |
| W093/15251 | 8/1993 | PCT US93/00950 |
| 754,796 | 1/1997 | EPO--. |

Signed and Sealed this

Eleventh Day of January, 2000

*Attest:*

*Attesting Officer*

Q. TODD DICKINSON

*Acting Commissioner of Patents and Trademarks*